US007469699B2

(12) United States Patent
Gossweiler

(10) Patent No.: US 7,469,699 B2
(45) Date of Patent: Dec. 30, 2008

(54) THIN PROFILE AIR PURIFYING BLOWER UNIT AND FILTER CARTRIDGES, AND METHOD OF USE

(75) Inventor: Otto Gossweiler, Effretikon (CH)

(73) Assignee: TVI Corporation, Glenn Dale, MD (US)

( * ) Notice: Subject to any disclaimer, the term of this patent is extended or adjusted under 35 U.S.C. 154(b) by 26 days.

(21) Appl. No.: 10/933,400

(22) Filed: Sep. 3, 2004

(65) Prior Publication Data

US 2006/0048782 A1 Mar. 9, 2006

(51) Int. Cl.
*A62B 19/00* (2006.01)

(52) U.S. Cl. ..... 128/205.12

(58) Field of Classification Search ..... 128/205.12, 128/205.27, 205.29, 206.17, 201, 205.25, 128/204.12, 898, 205.18, 205.28, 206.16, 128/204.24, 201.13, 910; 403/362; 55/DIG. 33, 55/DIG. 34, DIG. 35, DIG. 32, 96; 604/312, 604/313, 317, 332, 333, 359
See application file for complete search history.

(56) References Cited

U.S. PATENT DOCUMENTS

| | | | | |
|---|---|---|---|---|
| 865,996 | A | 9/1907 | Catt | |
| 1,105,127 | A | 7/1914 | Drager | |
| 1,169,996 | A | 2/1916 | Prindle | |
| 3,018,776 | A | 1/1962 | Saitta | |
| 3,044,464 | A | 7/1962 | Gray | |
| 3,413,972 | A * | 12/1968 | Depping | 128/201.23 |
| 3,464,487 | A * | 9/1969 | Gold et al. | 165/216 |
| 3,715,032 | A | 2/1973 | Nicko | |
| 3,731,717 | A | 5/1973 | Potash | |
| 3,852,196 | A | 12/1974 | Szpur | |
| 3,990,439 | A | 11/1976 | Klinger | |
| 4,243,029 | A | 1/1981 | Apple | |
| 4,257,415 | A | 3/1981 | Rubin | |
| 4,384,576 | A | 5/1983 | Farmer | |
| 4,402,316 | A | 9/1983 | Gadberry | |
| 4,433,684 | A | 2/1984 | Sarnoff | |
| 4,493,614 | A | 1/1985 | Chu | |
| 4,513,741 | A | 4/1985 | Demi | |
| 4,529,514 | A | 7/1985 | Gruett | |
| 4,574,799 | A | 3/1986 | Warnke | |

(Continued)

FOREIGN PATENT DOCUMENTS

| | | | |
|---|---|---|---|
| DE | 4241033 | A1 | 6/1994 |

(Continued)

*Primary Examiner*—Justine R. Yu
*Assistant Examiner*—Shumaya B Ali
(74) *Attorney, Agent, or Firm*—Whiteford, Taylor & Preston LLP; R. Christopher Rueppell; Jeffrey C. Maynard

(57) ABSTRACT

A thin profile PAPR filter blower system and method of use that operates in conjunction with a thin profile filter cartridge. The design allows an unaided user to swap filter cartridges without compromising the safety of the user, even when the user is located in a contaminated environment. Other components of the system include a blower control mechanism, a short conduit for delivering filtered air to a worn face mask, a self-contained power supply, optional attachment features to secure the system to a wearer's body, features for sealably connecting and replacing filter cartridges, and a quick change locking mechanism to secure and release filter cartridges. An optional remotely located control device is also provided.

47 Claims, 7 Drawing Sheets

U.S. PATENT DOCUMENTS

| | | | | |
|---|---|---|---|---|
| 4,682,993 | A | 7/1987 | Todd | |
| 4,823,785 | A | 4/1989 | Mancosu | |
| 4,841,963 | A | 6/1989 | Vandeputte | |
| 4,915,106 | A | 4/1990 | Aulgur | |
| 4,924,861 | A | 5/1990 | Kiske | |
| 4,936,298 | A | 6/1990 | Nishina | |
| 4,961,420 | A | 10/1990 | Cappa | |
| 4,971,051 | A | 11/1990 | Toffolon | |
| 5,036,846 | A | 8/1991 | Aulgur | |
| 5,065,745 | A * | 11/1991 | Meier | 128/205.12 |
| 5,209,226 | A | 5/1993 | Goodley | |
| 5,235,972 | A | 8/1993 | Strong | |
| 5,427,091 | A | 6/1995 | Phillips | |
| 5,503,147 | A | 4/1996 | Bertheau | |
| 5,690,102 | A | 11/1997 | Bertheau | |
| 5,914,037 | A | 6/1999 | Yen | |
| 6,039,045 | A | 3/2000 | Bertheau | |
| 6,155,258 | A | 12/2000 | Voege | |
| 6,214,074 | B1 * | 4/2001 | Silviera et al. | 55/385.4 |
| 6,269,811 | B1 * | 8/2001 | Duff et al. | 128/204.21 |
| 6,325,116 | B1 | 12/2001 | Savage | |
| 6,615,828 | B1 | 9/2003 | Petherbridge | |
| 6,796,304 | B2 * | 9/2004 | Odell et al. | 128/201.29 |
| 6,834,650 | B1 | 12/2004 | Fini | |
| 6,837,239 | B2 | 1/2005 | Beizndtsson | |
| 7,101,412 | B2 | 9/2006 | Gossweiler | |
| 7,118,608 | B2 * | 10/2006 | Lovell | 55/385.1 |
| 2003/0005932 | A1 | 1/2003 | Rydgren | |
| 2003/0010001 | A1 * | 1/2003 | Bryce et al. | 55/467 |
| 2005/0051235 | A1 | 3/2005 | Gossweiler | |
| 2005/0103343 | A1 | 5/2005 | Gossweiler | |
| 2005/0126572 | A1 | 6/2005 | Gossweiler | |
| 2005/0263155 | A1 | 12/2005 | Gossweiler | |

FOREIGN PATENT DOCUMENTS

| | | | |
|---|---|---|---|
| WO | 2005035365 | A2 | 4/2005 |
| WO | 2005055912 | A2 | 6/2005 |
| WO | 2005060374 | A2 | 7/2005 |
| WO | 2005061076 | A1 | 7/2005 |
| WO | 2005118072 | A1 | 12/2005 |
| WO | 2006028467 | A2 | 3/2006 |

* cited by examiner

THIN PROFILE AIR PURIFYING BLOWER UNIT AND FILTER CARTRIDGES, AND METHOD OF USE

BACKGROUND OF THE INVENTION

1. Field of the Invention

The present invention relates to a thin profile air purifying filter blower having a thin replaceable filter cartridge that provides enhanced portability and wearability, with the capability to easily replace the filter cartridge even during location of the unit in hot zones.

2. Description of Related Art

Respiratory devices, such as protection masks, also interchangeably referred to herein as face masks or masks, are well known. Civilians, law enforcement, military personnel, fire fighters and other groups of individuals (often referred to as "responders"), as well as others (herein collectively referred to as "users"), wear masks for protection in environments containing harmful, and even hazardous, airborne toxins, and other hazardous or noxious materials. Such toxins and other materials can be hazardous upon exposure to respiratory systems and generally take the form of harmful gases, vapors, aerosols, or particulates. The respiratory hazards may result from various agents, such as nuclear, biological and chemical (NBC) agents.

One type of breathing apparatus, known as a Powered Air Purifying Respirator (PAPR) (also referred to interchangeably herein as "PAPR protection system"), provides for fan-forced positive pressure breathing. PAPR protection systems are typically used in environments in which ambient air is relatively oxygen-rich and where filtering elements are effective in removing contaminants before the air is inhaled by the user. PAPR protection systems typically include a face mask, a filtering element that removes contaminants from the air, a blowing element (interchangeably referred to herein as a "blower"), such as a fan, and a power source that provides operational power to the blowing system. In operation, the fan or other blowing element continuously supplies filtered air to the face mask, where the filtered air replenishes the internal space of the mask. Exhaled air (also interchangeably referred to herein as "spent air"), in turn, is continuously expelled.

Conventional PAPR protection systems have numerous drawbacks. For example, most existing PAPR protection systems do not allow simple and efficient exchange of spent filters for new filters, especially in contaminated environments. One typical hindrance to efficient exchange of filters in conventional PAPR protection systems is the use of threaded connector parts for connecting the replaceable filters. When swapping filters in these conventional PAPR systems, the user must unscrew the old, spent filter from the filter port, discard the used filter, quickly position a new, unspent filter into the filter port to limit exposure to ambient air through the unfiltered filter port, and then thread the new filter into the port. Accordingly, the process of exchanging filters in these systems is both time-consuming and can lead to increased risk of exposure of the user to contaminants, especially if the filter port is even briefly opened or otherwise unprotected.

Due to these drawbacks, PAPR protection systems are limited in their applicability and range of use. For example, the potential exposure to contaminants in ambient air during filter exchange results in conventional PAPR protection systems typically allowing swapping of filters only in safe zones (interchangeably referred to herein as "clean zones")—those areas where the ambient environment does not contain toxic, harmful, or otherwise to be avoided contaminants. In addition, a conventional PAPR system user may require some level of decontamination prior to replacing the filter within the clean zone.

Another drawback of conventional PAPR protection systems is that the filters themselves are typically bulky and cumbersome. Conventional PAPR protection systems generally have relatively large, projecting cylindrically shaped filter cartridges. For example, when the main body of such a system is worn on a user's back, as occurs in typical use, the cartridges project from the user's body. This configuration results in the systems being bulky and cumbersome, severely hindering user freedom of movement, and often rendering conventional PAPR system use impractical in some environments. For example, a user carrying the bulk of a conventional PAPR system on the back must account for the relatively large size PAPR when entering cramped spaces. As a result, conventional PAPR protection systems have limited usefulness in such limited space environments as vehicles, airplanes, and buildings, and their use may adversely impact maneuverability when used in such applications as combat situations. The user must also account for the added bulk of PAPR systems when performing such actions as rolling, crouching, or ducking.

Yet another drawback of wearing the bulk of a conventional PAPR protection system on the back is the difficulty that this location presents to the user when filter replacement is necessary. Rather than allowing users to carry out such replacement by themselves, the aid of a second person is often required. The inability of users to exchange filters by themselves can thereby increase the risk to the user and decrease range of operation, since these users must rely on a second person typically remote from the working environment when the sometimes urgent need for filter replacement occurs.

Alternatively to wearing the main body of a conventional PAPR system on the back, the bulk of these systems may be attached at the user's waist. While such usage reduces some problems associated with wearing on the back, such as difficulty with unaided replacement of filter cartridges, other problems remain with this approach. For example, whether the main body of the system is located on the back or at the waist, a lengthy connection hose typically must extend from the main body of the system to the air inlet of the face mask. As a result of the need for a lengthy breathing hose, conventional PAPR systems generally have increased airflow loss and greater breathing resistance than systems having short hoses. Moreover, the long breathing air hose has a greater tendency to become kinked, damaged, or entangled during use, potentially both restricting movement of the user and increasing the danger of loss or contamination of air supply.

Accordingly, there remains an unmet need in the art for a PAPR protection system that allows users a wider range of operation and increased ease of use. There is a corresponding similar need for a PAPR system that allows users less limited range of motion and access to areas of limited space. In particular, there is an unmet need for a PAPR protection system that is less cumbersome and bulky than conventional PAPR protection systems, yet maintains the volumetric flow rate of filtered air of conventional PAPR filters. Furthermore, there is an unmet need in the art for a PAPR protection system that allows users to quickly and safely swap filter cartridges (also interchangeably referred to herein as "filters") in an efficient manner, without subjecting the user to possible dangers that may be present in the ambient environment, while also allowing various components, including the filter cartridges, to be stored and transported effectively and efficiently.

SUMMARY OF THE INVENTION

In order to overcome these needs, as well as others, the present invention provides a thin profile PAPR blower system and method of use that operates in conjunction with a replaceable thin profile filter cartridge. Features of the present invention allow a user to swap spent filter cartridges for new filter cartridges, without assistance and without compromising the safety of the user, even when the user is located in a hot zone.

The resulting system of the present invention is more compact, maneuverable, portable, and safer than PAPR protection systems of the prior art. The present invention can be conveniently worn against the user's side, back or front, in a manner so as to allow the user to perform a wide range of maneuvers, such as rolling or lying on the stomach, that are not easily performed when wearing conventional PAPR systems. The thin profile design of the present invention also allows the blower units and filters to be easily and efficiently stacked or otherwise packed, thereby allowing more efficient transport or portability than the conventional blowers and filters. Moreover, the unique configuration of the thin profile filter provides an increase of approximately 25% relative to conventional filters with respect to the volume of filtered air.

Various other components of the present invention include a control mechanism, such as an on/off switch or other blower modulator, a minimal length hose or other conduit for delivering filtered air to the face mask, a power supply contained within the PAPR system housing, specialized attachment mechanisms for securing the bulk of the system to the user's body, features for sealably connecting and replacing filter cartridges, and a quick change locking mechanism to secure the filter cartridges when installed to the system. In some embodiments, a remotely located control device is also provided, facilitating, for example, control of blower functions in situations limiting access to housing located controls.

The thin profile design of the filter component of the present invention includes the compact use of one or more filter elements arranged so as to effectively filter contaminants or other materials contained in intake air. The filtering elements can be of any of various types known in the art, so long as intake air is able to enter and pass through the filtering elements, where toxins or other materials are removed and trapped, with only filtered air passing through. The filter component of embodiments of the present invention also includes a slidable and removable cover, which is ejected when the filter is installed.

In another aspect of the present invention, the blower and/or filter cartridges include features to secure the bulk of the system to the user's body. In particular, either or both of the filter and blower may include attachment mechanisms connectable to harnesses or other mounting devices worn by the user, so as to secure the system against the user's body (e.g., chest, back, or sides) without significantly restricting the user's motion.

In one embodiment of the present invention, the filter is attached to an attachment location at the lower end of the blower unit. When a filter becomes spent, a new filter may be slidably installed to replace the spent filter, and the spent filter simultaneously ejected, without the blower losing sealed engagement with at least one of the filters at all times. In one embodiment, grooves are provided on each filter that are configured so as to allow mating engagement with corresponding guides located at an attachment location on the lower surface of the blower. As the new filter is slidably engaged into position on the blower, the filter to be replaced slides out of position and is ejected from the PAPR protection system. Seals located on one or both of the grooves and guides ensure that during the exchange of filters and during operation, contaminants from the ambient environment are unable to enter the PAPR protection system.

In operation, air is drawn into the filter by the blower, passes through the filter to the blower, and is driven from the blower to the face mask, where the user inhales the filtered air. Air is driven to the face mask via a filter outlet angled relative to the blower body and an air hose or other conduit that smoothly connects the blower and the face mask. As a result of the angling of the filter and location of the bulk of the system on the user's chest when so worn, a shorter air hose or other conduit is required than for conventional protection systems, thereby reducing the likelihood of kinking or other damage occurring during use. When worn on the front side of the user's body, the system's operations may also be easily monitored by the user.

Additional aspects, advantages, and novel features of the present invention will become more apparent from the following description, with reference to the accompanying drawings.

DETAILED DESCRIPTION OF THE PRESENT INVENTION

Figure 1:
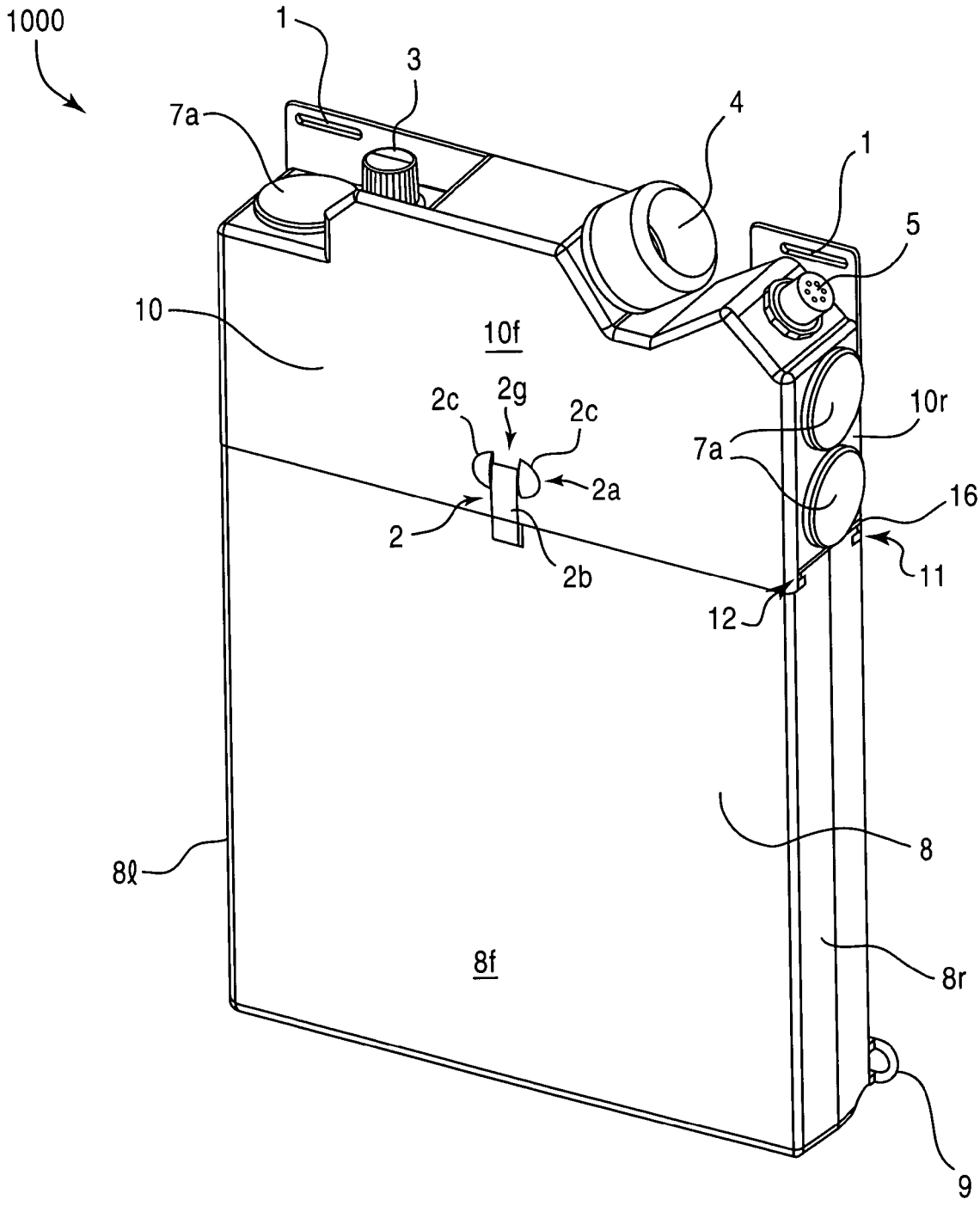
FIG. 1 is a perspective view of a blower and filter of the present invention, in accordance with one embodiment of the present invention.

The present invention provides a thin profile PAPR filter blower system and method of use that operates in conjunction with a thin profile filter cartridge. Among other advantages, the present invention allows an unaided user to swap filter cartridges without compromising the safety of the user, even when the user remains located in a contaminated environment during filter exchange. Other components of the system include a blower control mechanism, a short hose or other conduit for delivering filtered air to a worn face mask, a self-contained power supply, optional attachment features to secure the system to a wearer's body, features for sealably connecting and replacing filter cartridges, and a quick change locking mechanism to secure and release filter cartridges. An optional remotely located control device is also provided.

Among other things, the present invention overcomes problems of the prior art by providing a thin profile PAPR protection system that facilitates swapping of thin profile filter cartridges. In one embodiment, both the filter and the blower unit have a rectangular cross-sectional shape. The rectangular shape allows for efficient stackability, which in turn allows for easier transport and storage of the units. The cross-sectional shape of the filter and blower may also be many other shapes, such as triangular, elliptical, or circular, that likewise allow the filter to maintain a thickness and shape supporting efficient stacking and transportation, as well as enhanced ease of use.

The thin profile shape of the filter of the present invention is generally more compact than the cylindrical shape of conventional filters, having a thickness much less than the standard diameter of 106 millimeters for existing filters. As a result, the blower and corresponding filter of the present invention have an overall size that is approximately one-third the size of a conventional filter and blower while providing an increase of approximately 25% in terms of the volume of filtered air. Although a reduction in size has always been desired in the art, the ability to reduce size while maintaining operability has not been previously accomplished in conventional filters and blowers.

While decreasing the overall size of the filter, the present invention nevertheless increases the volume of filtered air and capacity by approximately 20-25%, compared to conventional filters. As a result, the filters of the present invention have a longer use life, as compared to the use life of typical conventional filters.

The above-identified and other features of the present invention also offer numerous additional advantages over conventional PAPR blowers. For example, the filter/blower unit of the present invention is less bulky and cumbersome than conventional filters and blowers, among other things allowing greater maneuverability for a user wearing the system. In one embodiment, the filter/blower unit is about two inches thick. In another embodiment the filter/blower unit is no more than four inches thick, preferably about three inches thick. As a result, users of the present invention are able to fit into tighter spaces than users of conventional PAPRs. Additionally, the present invention allows the user to operate with a wide range of motion and to perform actions that are otherwise difficult with conventional PAPR blowers. For example, the thin profile design of the present invention permits users to perform such actions as laying down, rolling, and crouching, which are difficult, if not impossible, with conventional filters and blowers.

Another benefit of the present invention is increased safety for the user. The present invention allows users to replace their own spent filters, even in hot zones, without compromising safety. The ability to swap the filter in a hot zone is generally known as "hot swappable." This function increases user safety because, for example, once a filter is spent, it can be readily replaced, and the user can continue to receive filtered air. In such operations, the present invention allows users to attach a replacement filter to the blower unit quickly, efficiently, and safely. As a result, users do not need to be concerned with the risk of potential exposure to toxins or contaminants. Due to the ability of the user to self-replace the filter, the user need not depend on assistance when a filter becomes spent.

Further, the air hose of other conduit of the present invention does not have to be as long as those of conventional blowers. The thin profile design of the present invention, combined with the angled air outlet, allows the air hose or other conduit to flowably connect to the mask with reduced risk of kinking, entanglement, or rupturing of the hose.

Yet another related benefit of the present invention over the prior art is increased applicability of PAPR protection systems. The filter/blower unit of the present invention allows such users as military personnel and first responders to enter areas previously inaccessible with conventional PAPR protection systems. Moreover, with the ability to swap filter cartridges without sacrificing safety, users have the capability to penetrate deeper into hot zones, swapping old filters for new filters along the way as filters become spent.

Embodiments of the present invention will now be discussed in greater detail with regard to FIGS. 1-7.

As shown in FIG. 1, in an embodiment of the invention, a thin profile blower unit 10 is operationally attached to a thin profile filter cartridge (also interchangeably referred to herein as "filter") 8. The flow of air through the filter 8 and to the blower 10 may occur via any of a number of paths, mechanisms, and methods known to those of ordinary skill in the art (including, for example, the particular pathways and mechanisms shown and described in greater detail with regard to FIGS. 5 and 6 below).

Collectively, the filter 8 and blower unit 10 comprise the bulk of the main body (non-face mask portion) 1000 of the system of the present invention. The main body 1000 can be manufactured from numerous suitable materials, such as plastic or other material that is relatively lightweight and durable. In one embodiment, components of the main body 1000 are constructed from carbon-reinforced plastic and/or covered by Kevlar®, made by DuPont of Wilmington, Del., or other bulletproof or impact-resistant material. Bulletproofing the main body 1000 provides an additional protection feature for users, particularly when the main body 1000 is worn on the user's chest, back or sides while the user is in combat or in other situations presenting impact hazards.

The filter 8 includes grooves 12 on one end that slidably engage corresponding guides 11 on one end of the blower unit 10. Thus, the grooves 12 on the filter 8 and the corresponding guides 11 on the blower unit 10 slidingly mate with each other to allow the filter 8 to be slidably attached to the blower unit 10.

Figure 2:
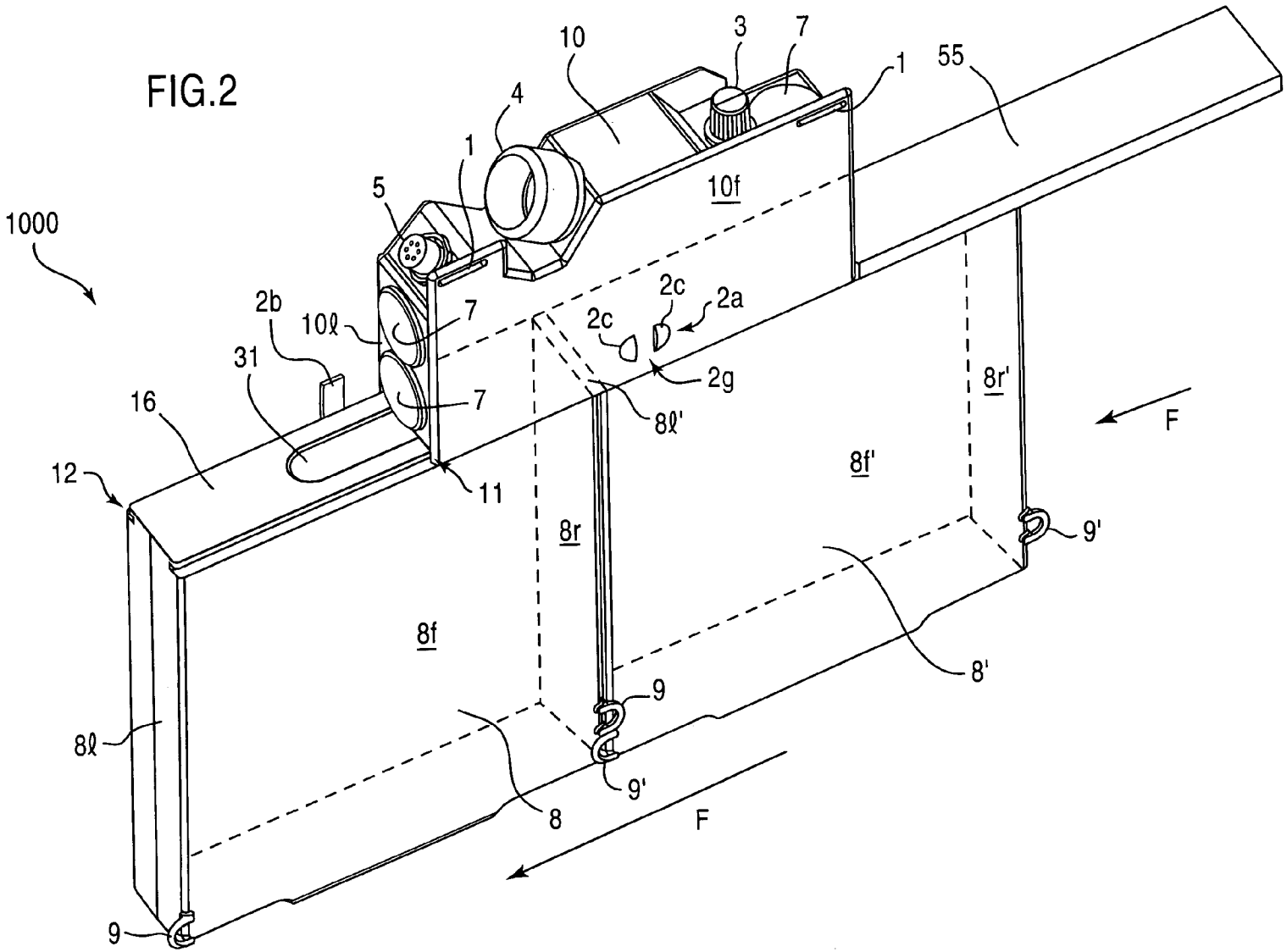
FIG. 2 presents a perspective view of a blower, wherein an old filter is being replaced by a new filter, in accordance with one embodiment of the present invention.
Figure 3A:
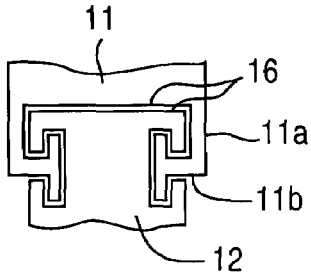
FIGS. 3A-3K contain cross-sectional illustrations of alternative exemplary grooves and guides used to engage the blower and filter, in accordance with one embodiment of the present invention.
Figure 3B:
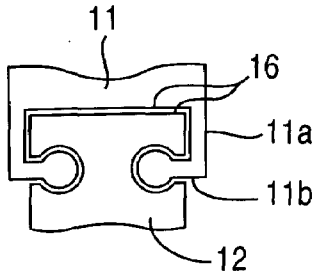
Figure 3C:
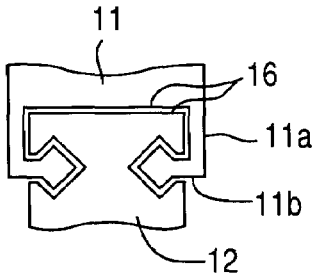
Figure 3D:
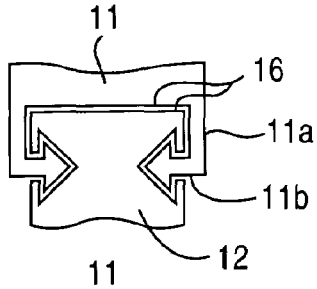
Figure 3E:
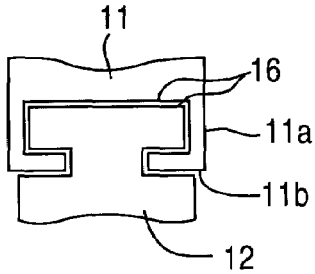
Figure 3F:
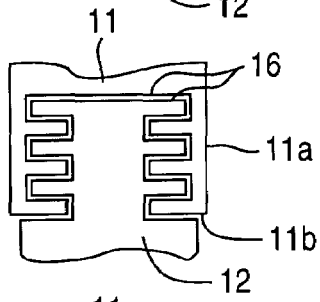
Figure 3G:
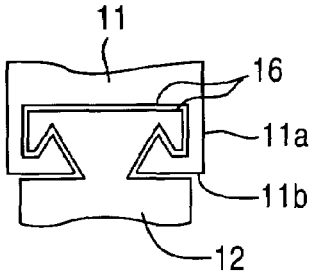
Figure 3H:
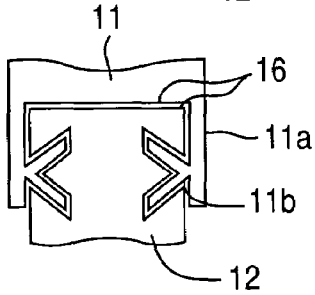
Figure 3I:
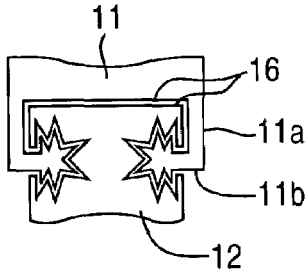
Figure 3J:
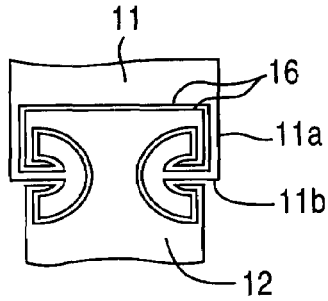
Figure 3K:
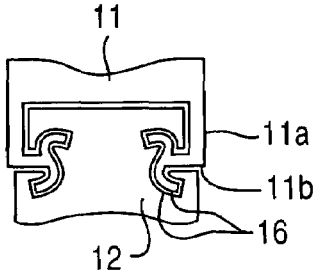

FIG. 2 illustrates the blower unit 10 during the process of a filter (e.g., a spent filter) 8 being replaced by a new replacement filter 8'. In some embodiments, the replacement filter 8' may be installed from either the right side or left side, relative to the front panel 10*f* of the blower unit 10, as shown in FIG. 2.

As shown in FIG. 2, in order to carry out replacement, the left face 8*l'* of the new filter 8' is placed flush against the right face 8*r* of the filter 8 to be replaced, and a sideways force F (e.g., user pressure) relative to the front face 10*f* of the blower unit 10, as shown in FIG. 2, is exerted on right face 8*r'* of the new filter 8'. This force F in turn is transmitted via the left face 8*l'* of the new filter 8' to the right face 8*r* of the filter 8 being replaced, thereby pushing the filter 8 being replaced along the grooves 12 and guides 11 of the blower unit 10 in the direction of the exerted force F.

The left face 8*l* of the filter 8 being replaced, which is distal from the force F exerted on the replacement filter 8', in turn also moves left, relative to left face 10*l* of the blower unit 10, as shown in FIG. 2. As the filter 8 being replaced travels, a filtered air aperture 31 on the filter 8, which is protected from the ambient environment when the filter 8 is operationally engaged with the blower unit 10, becomes exposed, but, due to its location, not while in communication with the interior of the blower unit 10. In contrast, when the filter 8 (or similarly with replacement filter 8') is fully engaged with the blower unit 10, the positioning of the air aperture 31 allows filtered air to flow from the filter 8 to the blower unit 10. Once the right face 8*r* of the filter 8 being replaced travels past the end of the guides 11 of the blower unit 10, the filter 8 is ejected.

Simultaneously with the travel and ejection of the filter 8 being replaced, the replacement filter 8' travels along the guides 11 until the left face 8*l'* and right face 18*r'* of the filter 8' generally align with the edges 10*l* and 10*r*, respectively, of the blower unit 10. The new filter 8 is then operationally engaged with the blower unit 10, and the air aperture of the replacement filter 8' (corresponding to air aperture 31 of the filter 8 being replaced) allows filtered air to flow from the replacement filter 8' to the interior of the blower unit 10.

In one embodiment, the replacement filter 8' includes a filter cover 55, which is disposed on the top end of new filter 8' prior to being attached to the blower unit 10. The filter cover 55 matingly attaches via the grooves of the replacement filter 8' (corresponding to the grooves 12 of the filter 8 being replaced) and protects the replacement filter 8 from contamination (e.g., ensures sterility of the replacement filter 8') prior to installation on the blower unit 10. In one embodiment, the filter cover 55 has the same cross-sectional shape as the guides 11 on the blower, allowing the filter cover 55 to engage matingly with the grooves on the filter 8' and to slide along these grooves during engagement of the replacement filter 8' with the blower unit 10.

As the replacement filter 8' travels into full engagement with the blower unit 10 along the grooves of the filter 8' via the guides 11 of the blower unit 10, the removable filter cover 55 is pushed (stripped) from the replacement filter 8'. When the filter 8' and blower unit 10 fully engage each other, the filtered air outlet of the replacement filter 8' communicates with a filtered air chamber of the blower unit 10, as, for example, described further below in conjunction with FIGS. 4-6.

FIGS. 3A-3K illustrate exemplary alternative embodiments of the grooves 12 of the filter 8, as shown in FIG. 2, and corresponding guides 11 of the blower unit 10, as shown in FIG. 2. In the embodiments shown in FIGS. 3A-3K, one feature of the grooves 12 and the guides 11 is that the grooves 12 and guides 11 are slidably engageable. As illustrated in FIGS. 3A-3K, the guides 11 each include a base portion 11*a*, which extends away from the top end of the blower unit 10, as shown in FIG. 2, and a leg portion 11*b*, which extends inwardly from the front face 10*f* and the back face 10*b* of the blower unit 10, as shown in FIG. 2. The leg portion 11*b* directly engages with the grooves 12 to slidably secure the filter 8 to the blower unit 10, as shown in FIG. 2. For example, as illustrated in FIGS. 3A-3K, respectively, cross-sectionally, the leg portion 11*b* of the guide 11 may be a) T-shaped; b) circular shaped; c) diamond-shaped; d) arrow-shaped; e) L-shaped; f) E-shaped; g) triangular-shaped; h) K-shaped; I) star-shaped; j) C-shaped; or k) S-shaped. The cross-sectional shapes are not limited to those illustrated in FIGS. 3A-3K, as the shape of the grooves 12 and the leg portion 11*b* of the guides 11 may take many shapes, provided that the shape of the grooves 12 corresponds to the shape of the guides 11 and allows the grooves 12 to engage sealably with the guides 11, similarly to as illustrated.

In one embodiment, the replacement filter 8' is further secured to the blower unit 10 (i.e., prevented from slidable movement) via a locking member, such as a filter safety lock 2, which is shown in a locked position in FIG. 1. A receiving portion 2*a* of the filter safety lock 2 is disposed, for example, on the front face 10*f* of the blower unit 10, with an engaging portion 2*b* of the lock 2 extending from the front face 8*f* of the filter 8. In another variation, the corresponding components of the filter safety lock 2 are disposed on the back face 10*b* of the blower and the back face 8*b* of the filter 8. In yet another variation, corresponding components of two filter safety locks 2 are used, with locks 2 being located on both the back face 10*b* and the front face 10*f* of the blower unit 10, and corresponding back face 8*b* and front face 8*f* of the filter 8.

In one variation, as shown in FIG. 1, the filter safety lock 2 includes a flexible engaging member 2*b*, which biasedly extends from the filter 8, the engaging member 2*b* being biased so as to abut the blower face 10*f* when the filter 8 and the blower unit 10 are engaged. In another variation, the extending member 2*b* is hingeably moveable so as to engage the receiving portion 2*a* of the lock 2 located on the blower 10. In the exemplary embodiment shown in FIG. 1, the receiving portion 2*a* includes one or more protruding extensions 2*c* disposed on the front face 10*f* of the blower unit 10, which are able to receive the engaging member 2*b* so as to secure the filter 8 to the blower unit 10. In yet another variation, the extending member is removably attachable (e.g., via snaps) to the receiving member.

In the variation shown in FIG. 1, the engaging member 2*b*, has a slight curvature as the engaging member 2*b* extends beyond the top of the filter 8. The protruding extensions 2*c* of the receiving member 2*a* disposed on the front face 10*f* of the blower unit 10 each likewise have curved surfaces to facilitate sliding engagement of the extending member 2*b*. The protruding extensions 2*c* of the receiving member 2*a* form a groove 2*g* between the extensions 2*c* for receiving and locking the engaging member 2*b*.

In operation, to engage the lock 2, as the filter 8 travels into place when being engaged with the blower unit 10, the engaging member 2*b* slidably passes over the curved surface of the first encountered one of the protruding extensions 2*c* and comes to rest in the groove 2*g* upon full engagement. Due, for example, to the biasing of the engaging member 2*b* against the face 10*f* of the blower 10, the engaging member 2*b* is biasedly retained in the groove 2*g*, and as a result, does not easily slide over the protruding extensions 2*c* after engagement. In one variation, once in the locked position, the filter may only easily be removed following manual retraction (e.g., lifting) of the engagement member 2*b* to allow travel past the extensions 2*c*.

In the embodiment illustrated in FIG. 1, the blower unit 10 includes features to extract filtered air from the filter 8 and transmit the filtered air to the user. A blower switch 3 is provided to allow the blower (e.g., electrically powered fan or air pump as is known in the art) housed within the blowing unit 10 to be selectively turned on and off. In one variation, the user is able to incrementally modulate the speed (e.g., via incremental power changes) of the blower using the switch 3. In another variation of the present invention, the switch 3 is supplemented by a panic button (not shown in FIG. 1), which allows the user to stop operation of the blower immediately (e.g., without incrementally reducing speeds, for example, as may be necessary in emergency situations).

Figure 4:
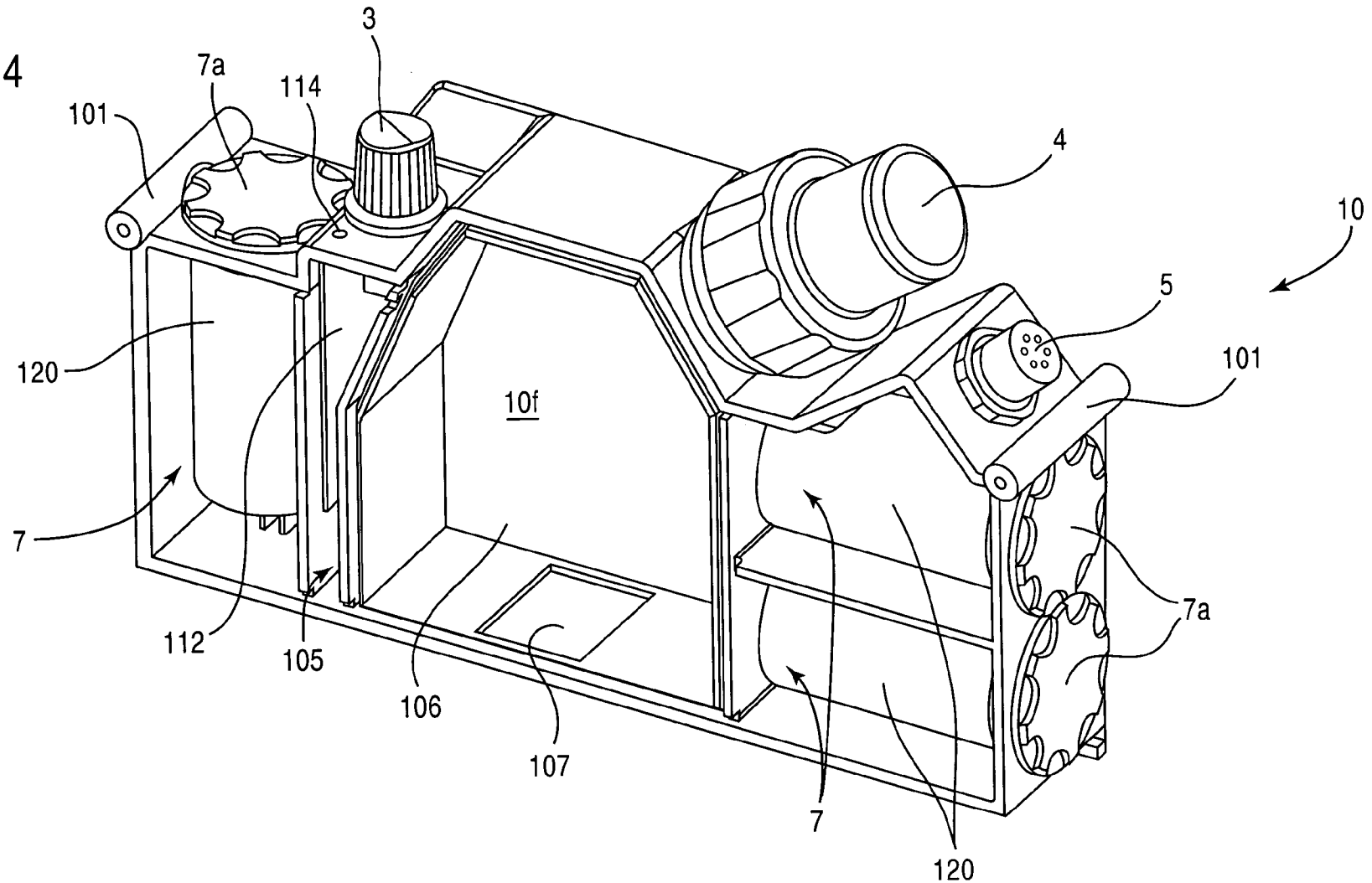
FIG. 4 is a perspective view of a blower housing with the front surface removed, in accordance with one embodiment of the present invention.

As further shown in the cutaway illustration of an exemplary blower unit 10 presented in FIG. 4, a blower control chamber 105 in the blower unit 10 houses a control device (e.g., a printed circuit board (PCB) or other device, such as or including a switch or potentiometer for variably controlling power transmission) 112, which is coupled to the blower control knob 3 to allow control operation and/or speed of the blower.

In one variation of the present invention, as shown in FIG. 4, a blower unit operation indicator 114, such as a light emitting diode (LED) is provided on the blower unit 10 to indicate when the blower unit 10 is operating. In one variation, any single color LED may be used to indicate when the blower unit 10 is operating. In another embodiment, a first color (e.g., green) LED is used to indicate that the blower is on, and a second color (e.g., red) LED is used to indicate that the blower is off.

Additionally, in one variation of the present invention, the blower unit 10 includes an external control connector 5, to which a remote control cable may be connected. The external control connector 5 is useful, for example, when the user wears the main body 1000 on the user's back, and the switch 3 on the blower unit 10 cannot be easily reached by the wearing user. In this situation, a remote switch may be connected to the blower 10 via the connector 5, and located, for example, on the user's chest, mask, or other easily reachable area. In one variation, the remote switch can be attached to the user via a clip. In some variations of the present invention, no switch 3 is present and the blower operates via pressure responsiveness (e.g., automatic operation based on breathing pressure of the wearing user), as is generally known in the art.

In an embodiment of the present invention, the blower includes a replaceable power source, such as batteries, to provide power to allow movement of the filtered air to the user. Any battery that provides sufficient power to the blower can be used. For example, in one embodiment, one or more rechargeable "D" size batteries provide power to the blower. In the variation shown in FIG. 4, the blower includes power cell chambers (one or more of which are interchangeably referred to herein as "battery housing areas") 7 to hold the batteries 120. The number of batteries and corresponding number of battery housing areas included in the blower unit 10 is determined by the size and available space in the blower unit 10, as well as the amount of power required to operate the blower.

In one variation, each battery housing area includes one or more battery covers 7*a* to facilitate replacement of the batteries within the blower unit 10. Operational and electrical connection of the batteries to the blower, via control device 112, and the switch 3, for example, may be made via wires, printed circuits, and/or other circuit components generally known in the art.

As further shown in the embodiment of FIG. 4, the blower unit 10 includes a filtered air chamber (also referred to interchangeably herein as the "central blower housing") 106 containing the blower and having a filtered air inlet 107. The blower unit 10 is attachable to a filter hose or other conduit for air flow, which, in turn, is connected to or connectable to the user's protection mask. To allow the air to flow from the blower unit 10 to the air hose or other conduit, in one embodiment, the blower unit 10 includes an air outlet 4, which optionally contains a filter. The construction of the air outlet 4 generally allows ready connection to the connected air hose or conduit, via methods and features known in the art. For instance, the air outlet 4 optionally includes connection features, such as threads or one or more lips, matably connectable with a corresponding feature of a connector attached to an air hose or other conduit. In one variation, the air outlet 4 is disposed at the top end of the blower unit 10, as shown in FIG. 4, and has an axis oriented at an upward angle relative to the blower unit 10 and in the direction of the face of the wearing user when the unit 10 is worn on the user's chest, as further shown in FIG. 7, below.

The angled disposition of the air outlet 4 thereby allows the connected hose or other conduit to have a minimized length in extending to a connected protection mask worn by the user. Furthermore, the angled disposition of the air outlet 4 allows for a smooth bend in the air hose leading to the user since, generally, the shorter the air hose, the greater the need for an air outlet 4 that creates a smooth bend in the air hose. The direction that the air outlet 4 extends relative to the blower unit 10 (e.g., to the right or left side of the blower unit 10, as shown in FIG. 4) depends on convenience in relation to various other features of the system (e.g., side of opening on worn mask for receiving hose or other conduit) and other factors, such as user comfort.

In order to enhance user wearability, embodiments of the blower unit 10 and/or filter 8 of the present invention include securing devices to secure the main body 1000 to the user. In the variation shown in FIG. 1, the blower unit 10 includes one or more shoulder belt or strap attachments 1 on the top end of the blower unit 10, as viewed in FIG. 1. As shown, the attachments 1 of this variation are disposed flush with the back face 10*b* of the blower unit 10, which is thereby free to rest against the user's body. In another variation, as illustrated in FIG. 4, shoulder belt or strap attachments 101 are provided that are cylindrical in shape and that include an aperture therethrough for receiving a connection mechanism (e.g., retractable or lockable pin) attached to the shoulder belt or strap, as known in the art. The attachments 101 of the exemplary variation shown in FIG. 4 are disposed along the entire width of the blower unit 10.

As further illustrated in FIG. 1, in some embodiments, extending from the back face 8*b* of the filter 8 are waist belt attachments 9. The waist belt attachments 9 allow connection of the filter 8 to, for example, a waist belt or strap (as further illustrated in FIG. 7, below), which can be further secured to the user. In the embodiment shown in FIG. 1 the waist belt attachments 9 are disposed on the bottom end of the filter 8. In another variation, more than one waist belt attachment 9, 9' extends radially from the filter 8, 8' one in a right direction and the other in a left direction relative to the front face 8*f*, 8*f'* of the filter 8, 8', respectively, as shown in FIG. 2. As further shown in FIG. 2, the right and left extending attachments 9, 9' may be staggered in their position relative to the bottom edge of the filter 8, 8', so as to prevent interference among the attachments 9, 9', respectively, during filter replacement. In yet another variation, the waist belt attachments 9 extend from the bottom edge of the filter. In some variations, as illustrated in FIG. 1, the disposition of the waist belt attachments 9 and the shoulder belt attachments 1 allows the filter/blower unit 1000 to securely and firmly rest against the user's body, as further shown in FIG. 7.

Figure 5:
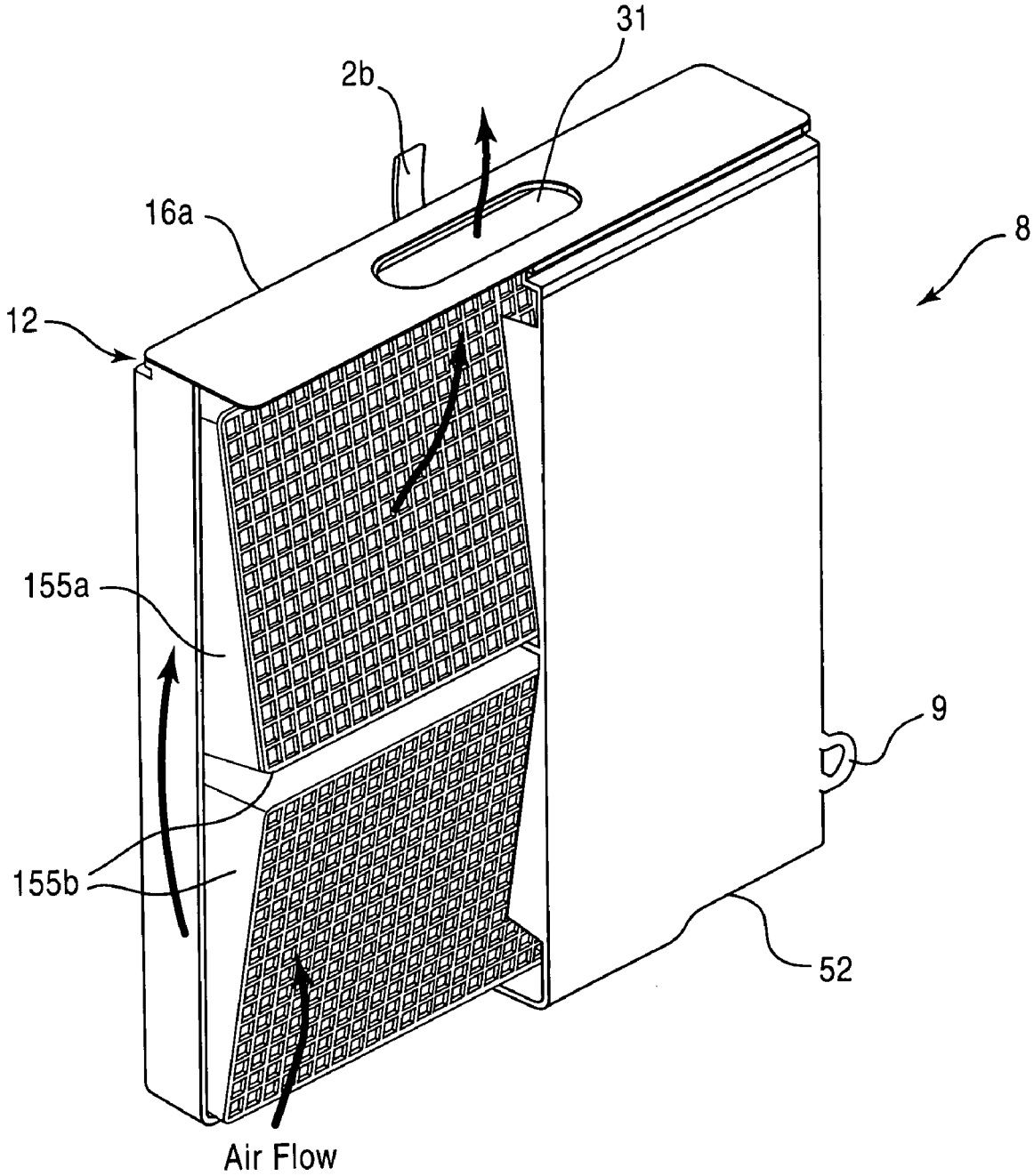
FIG. 5 contains a partial cross-sectional view of the front of an exemplary filter, in accordance with one embodiment of the present invention.
Figure 6:
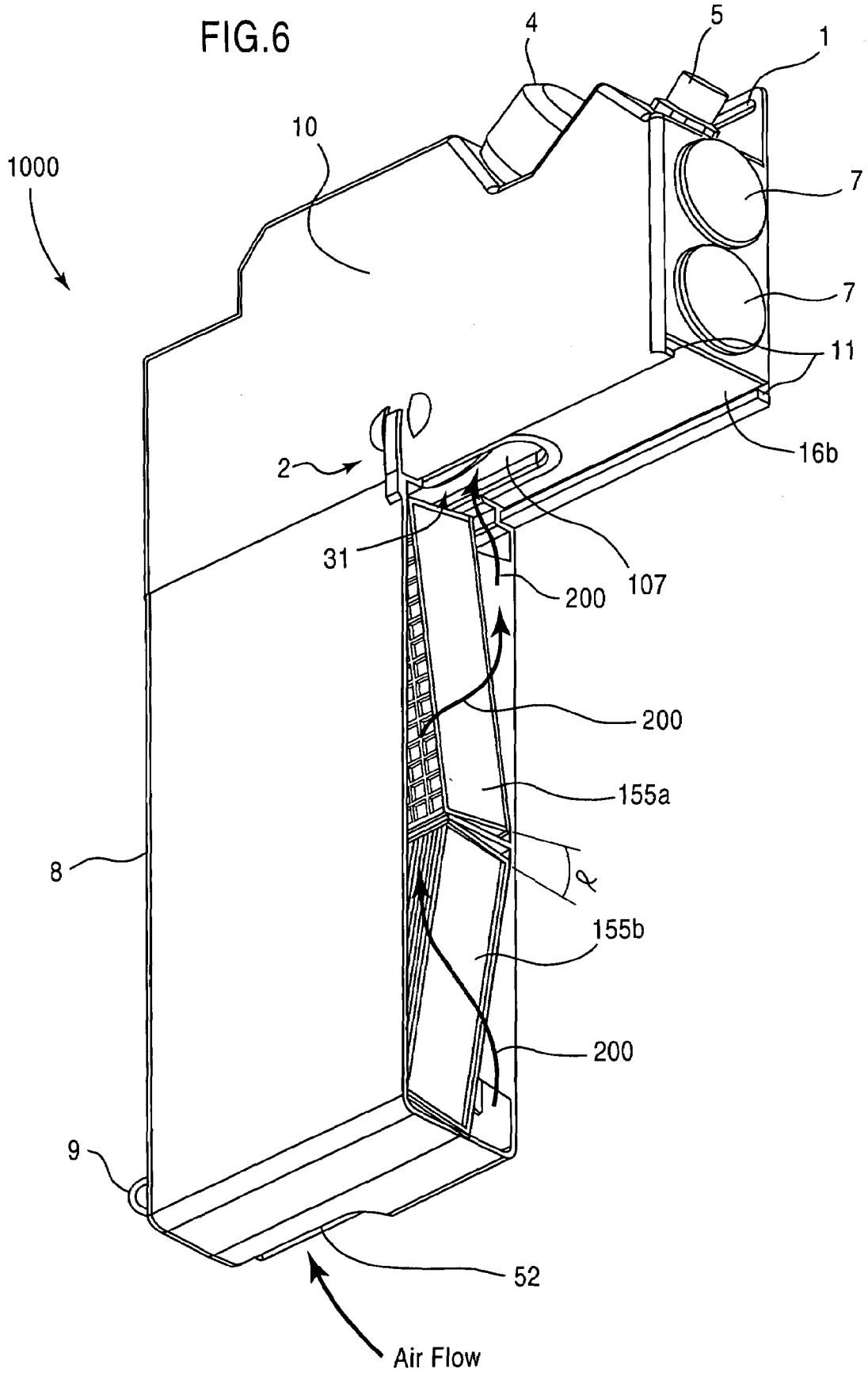
FIG. 6 presents a partial cross-sectional view of a filter installed with a blower unit, in accordance with one embodiment of the present invention.

Various other aspects of the filter 8 of the present invention will now be described in further detail in conjunction with FIGS. 5 and 6, which show partial cutaway views of an exemplary filter 8. As shown in FIG. 5, in embodiments of the present invention, flexible seal material (also interchangeably referred to herein as "gaskets") 16*a*, such as rubber padding, line the grooves 12. As shown in FIG. 6, flexible seal material 16*b* likewise lines corresponding locations on the guides 11. The flexible seal material 16*a* of the filter 8, when abutting the flexible seal material 16*b* of the blower unit 10, serves to seal the filter 8 against the blower unit 10, thereby preventing contamination. Generally the flexible seal material 16*a*, 16*b* is adhered (e.g., glued) to the guides 11 and grooves 12 so as to maintain the flexible seal material in place on the blower unit 10 and filter 8, respectively. During sliding action to install a replacement filter, for example, the flexible seal material 16*a* on the grooves 12 and the material 16 on the guides 11 abut, forming a seal therebetween. The seal formed between the abutting flexible seal material 16*a*, 16*b* remains in place when the filter 8 is in the operational position with respect to the blower unit 10.

Generally, the filter 8 can perform its function of filtering ambient air in any number of ways, as known in the art, and any filtering mechanism that can effectively remove harmful or noxious contaminants and/or toxins from filtered air prior to inhalation by the user can be used with the present invention. For example, any present or future developed filter approved by the National Institute of Safety and Occupational Health (NIOSH) may typically be incorporated in the filter of the present invention.

As particularly shown in FIG. 5, in one embodiment, the filter 8 contains two filtering elements 155*a*, 155*b*, comprising a paper filter and a carbon filter, respectively. The filter 8 of this embodiment optionally also includes a removable filter cover 55, as shown in FIG. 2, which is shaped to fit and slide on corresponding grooves 12 of the filter 8.

As shown in FIG. 6, upon installation of the filter 8 with the blower unit 10, air is able to enter the filter 8 via an inlet (also interchangeably referred to herein as the "air entry aperture") 52 and exit through the air outlet (also interchangeably referred to herein as the "filtered air aperture") 31. The flow of the air within the filter 8 varies by the type and number of filtering elements 155*a*, 155*b* used. For example, FIGS. 5 and 6 illustrate the cross-sectional representation of a filter 8 containing two filtering elements 155*a*, 155*b*. The filter elements 155*a*, 155*b* of this variation are, for example, selected so as to be capable of filtering contaminated air containing particular types of contaminants or other material to be filtered. In one variation, the filtering elements 155*a*, 155*b* are disposed at an angle a relative to each other, as shown in FIG. 6, so as to enhance air flow via crossflow. As shown, the angled orientation of the filtering elements 155*a*, 155*b* results in flow 200 across large surface areas of each filter element 155*a*, 155*b*, even though the two filter elements 155*a*, 155*b* are generally disposed end to end, as illustrated. The air outlet 31 allows the filtered air, following passage across each filter element 155*a*, 155*b* to flow to the blower unit 10. Additionally, to improve air flow within the filter 8 and to channel air efficiently, the filter 8 may be equipped, for example, with one or more guide rings.

As further illustrated in FIG. 6, air exiting the filter 8 flows through a communication channel defined by the adjacent filtered air aperture 31 and blower air inlet 107 formed between the abutting blower unit 10 and filter 8.

Figure 7:
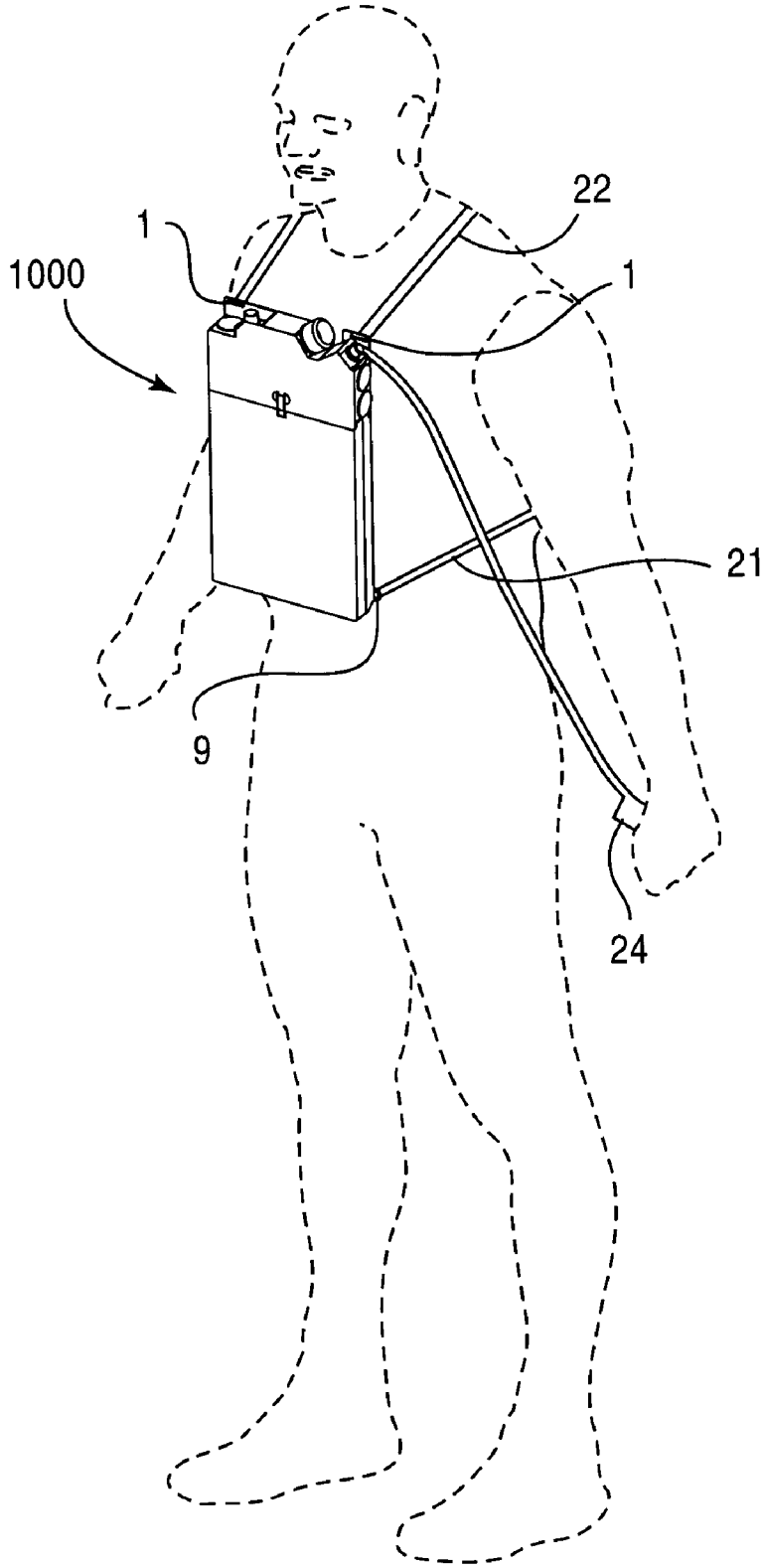
FIG. 7 is a schematic diagram illustrating a blower and filter unit worn against a user's chest, in accordance with one embodiment of the present invention.

Generally, the main body 1000 of the present invention may be worn against the user's stomach and/or chest, as illustrated in FIG. 7. The main body 1000 of the present invention may also be worn against the user's back. Depending on the overall size of the present invention, which is variable according to numerous factors, such as the needs and usage of the PAPR, the user may wear the main body 1000 against the user's waist or on the side of the user's torso. It is important to note that a length of the air hose may be varied depending on the distance between the user's mask (i.e., air inlet) and the selected wear position of the blower unit 10.

In the embodiment shown in FIG. 7, straps, harnesses, or like cloth, fiber, or synthetic materials known in the art make up the attachment extensions 21, 22 that secure to the various attachment points of the of the main unit 1000, such as the shoulder attachment points 1 and attachment points 101 of the blower unit 10, as shown in FIGS. 1 and 4, respectively, and the waist belt attachment points 9, 9', as shown in FIGS. 1, 2 and 4-6. In the variation shown in FIG. 7, shoulder belt attachment points 1 of the main body 1000 attach to shoulder or neck straps 22, and waist belt attachment points 9 for the main body 1000 are attached to a waist belt 21 drawn around the user's body.

Also shown in FIG. 7 is an exemplary remote control unit 24 located near the user's hand and attached to the main unit 1000.

While there has been described what are at present considered to be preferred embodiments of the present invention, it will be understood that various modifications may be made thereto, and it is intended that the appended claims cover all such modifications as fall within the true spirit and scope of the invention. Other modifications will be apparent to those skilled in the art.

What is claimed is:

1. A filter and blower unit for a powered air purifying respirator, comprising:

a thin profile blower unit having a filter engagement feature;

a replaceable thin profile filter having a blower unit engagement feature and a plurality of filter elements; and a first one of the plurality of filter elements has a thin profile in a first element profile direction and a first element axis perpendicular to the first element profile direction, wherein a second one of the plurality of filter elements has a thin profile in a second element profile direction and a second element axis perpendicular to the second element profile direction, the first one of the plurality of filter elements being abuttably disposed to the second one of the plurality of filter elements such that the first element axis and the second element axis form an oblique angle and such that the abutting first one and second one of the plurality of filter elements together maintain a combined thin profile, wherein the first one and second one of the plurality of filter elements allow a flow path thereacross, the flow path including a path portion in the first element thin profile direction and a path portion in the second element thin profile direction;

wherein the filter is slidably engageable with the blower.

2. The filter and blower unit of claim 1, wherein the filter engagement feature comprises at least one guide formed on a first end of the blower unit.

3. The filter and blower unit of claim 2, wherein the blower unit engagement feature comprises at least one groove formed on a first end of the filter, wherein the at least one groove slidably engages the at least one guide.

4. The filter and blower unit of claim 3, wherein the at least one guide has a cross-sectional shape portion selected from a group consisting of T-shaped, circular shaped, diamond-shaped, arrow-shaped, S-shaped, E-shaped, triangular-shaped, K-shaped, star-shaped, and C-shaped.

5. The filter and blower unit of claim 1, wherein the filter engagement feature includes a flexible seal material.

6. The filter and blower unit of claim 1, wherein the blower unit engagement feature includes a flexible seal material.

7. The filter and blower unit of claim 1, wherein the filter further comprises:

an ejectable filter cover that covers the blower unit engagement feature, wherein the filter cover seals the thin profile filter from an ambient environment.

8. The filter and blower unit of claim 7, wherein the ejectable filter cover is ejected upon replacement of the thin profile filter.

9. The filter and blower unit of claim 1, wherein the blower unit further comprises an air outlet.

10. The filter and blower unit of claim 1, wherein the blower unit includes a blower unit air inlet.

11. The filter and blower unit of claim 10, wherein the filter includes a filter air outlet, and wherein, when the filter is slidably engaged with the blower unit, the blower unit air inlet and the filter air outlet align to form an air conduit.

12. The filter and blower unit of claim 10, wherein the blower unit air inlet is sealed from an ambient environment during replacement of the thin profile filter.

13. The filter and blower unit of claim 1, wherein the blower unit further comprises a blower unit air outlet.

14. The filter and blower unit of claim 13, wherein the blower unit air outlet has an axis and extends from a first edge of the blower unit, the axis of the blower unit air outlet being at an oblique angle relative to the first edge of the blower unit.

15. The filter and blower unit of claim 1, wherein the blower unit further comprises at least one blower attachment feature for attaching the blower unit to a wearer.

16. The filter and blower unit of claim 1, wherein the blower unit further comprises a self-contained power source.

17. The filter and blower unit of claim 16, wherein the self-contained power source includes at least one battery.

18. The filter and blower unit of claim 1, wherein the blower unit further comprises a blower.

19. The filter and blower unit of claim 18, wherein the blower unit further comprises a control switch to control the blower.

20. The filter and blower unit of claim 19, wherein the control switch allows variable control of the blower.

21. The filter and blower unit of claim 1, wherein the blower unit further comprises an external control connector.

22. The filter and blower unit of claim 1, wherein the blower unit further comprises a blower unit operation indicator.

23. The filter and blower unit of claim 1, wherein the blower unit further comprises a safety lock receiving feature.

24. The filter and blower unit of claim 23, wherein the filter further comprises a safety lock engaging feature engageable with the safety lock receiving feature of the blower unit.

25. The filter and blower unit of claim 1, wherein the filter further comprises a safety lock receiving feature.

26. The filter and blower unit of claim 25, wherein the blower unit further comprises a safety lock engaging feature engageable with the safety lock receiving feature of the filter.

27. The filter and blower unit of claim 1, wherein the filter further comprises at least one filter attachment feature for attaching the filter to a wearer.

28. The filter and blower unit of claim 1, wherein the filter and blower unit comprise a bulletproof material.

29. A thin profile filter, comprising:

a housing having an interior with a first end, a second end, and a thin profile, wherein the housing has an air inlet and an air outlet;

a first filter element having a thin profile in a first thin profile direction and a larger cross-sectional profile normal to the first thin profile direction, the first filter element being contained within the housing, wherein a first end of the first filter element abuts the first end of the housing;

a second filter element having a thin profile in a second thin profile direction and a larger cross-sectional profile normal to the second thin profile direction, the second filter element being contained within the housing, wherein a first end of the second filter abuts the second end of the housing;

wherein a second end of the first filter element abuts a second end of the second filter element, the first element and the second element abutting at an oblique angle;

wherein air is received via the air inlet, flows through the first filter element across the larger cross-sectional profile in the first thin profile direction, flows through the second filter element across the larger cross-sectional profile in the second thin profile direction, and is expelled via the air outlet.

30. The thin profile filter of claim 29, wherein the housing includes a blower unit engagement feature that is slidably engageable with a housing engagement feature included on a blower unit and at least one of the housing engagement feature or blower unit engagement feature includes a flexible seal material.

31. The thin profile filter of claim 30, wherein the housing engagement feature comprises at least one guide formed on a first end of the blower unit and the blower unit engagement feature comprises at least one groove formed on an exterior first end of the housing wherein the at least one groove slidably engages the at least one guide.

32. The thin profile filter of claim 31, wherein the at least one guide has a cross-sectional shape portion selected from a group consisting of T-shaped, circular shaped, diamond-shaped, arrow-shaped, S-shaped, E-shaped, triangular-shaped, K-shaped, star-shaped, and C-shaped.

33. The thin profile filter of claim 30, wherein the housing further comprises:

an ejectable housing cover that covers the blower unit engagement feature and is ejected upon replacement of the housing, wherein the housing cover seals the housing from an ambient environment; and a housing attachment feature for attaching the housing to a wearer.

34. The thin profile filter of claim 30, wherein the blower unit further comprises:

a blower unit air outlet having an axis and extends from a first edge of the blower unit, the axis of the bower unit air outlet being at an oblique angle relative to the first edge of the blower unit; and a blower unit air inlet, wherein the blower unit air inlet and the housing air outlet align to form an air conduit.

35. The thin profile filter of claim 34, wherein the blower unit air inlet is sealed from an ambient environment during replacement of the housing.

36. The thin profile filter of claim 30, wherein the blower unit further comprises:

a blower connected to a control switch for controlling the operation of the blower;

a self-contained power source including at least one battery operationally connected to the blower;

blower unit operation indicator connected to the blower; and a blower unit attachment feature.

37. The thin profile filter of claim 30, wherein the blower unit further comprises an external control connector.

38. The thin profile filter of claim 30, further comprising at least one of:

a. a safety lock receiving feature of the blower unit engageable with a safety lock engaging feature of the housing; and b. a safety lock receiving feature of the housing engageable with a safety lock engaging feature of the blower unit.

39. A filter and blower unit for a powered air purifying respirator, comprising:

a thin profile blower unit having a filter engagement feature; and a replaceable thin profile filter having a blower unit engagement feature and a plurality of filter elements; and a first one of the plurality of filter elements has a thin profile in a first element profile direction and a first element axis perpendicular to the first element profile direction, wherein a second one of the plurality of filter elements has a thin profile in a second element profile direction and a second element axis perpendicular to the second element profile direction, the first one of the plurality of filter elements being abuttably disposed to the second one of the plurality of filter elements such that the first element axis and the second element axis form an oblique angle and such that the abutting first one and second one of the plurality of filter elements together maintain a combined thin profile, wherein the first one and second one of the plurality of filter elements allow a flow path thereacross, the flow path including a path portion in the first element thin profile direction and a path portion in the second element thin profile direction;

wherein the filter is slidably engageable with the blower and a blower unit air inlet is sealed from an ambient environment during replacement of the thin profile filter.

40. The filter and blower unit of claim 39, wherein the filter further comprises:

an ejectable filter cover that covers the blower unit engagement feature and is ejected upon replacement of the filter, wherein the filter cover seals the thin profile filter from an ambient environment; and a filter attachment feature for attaching the filter to a wearer.

41. The filter and blower unit of claim 39, wherein the filter engagement feature comprises at least one guide formed on a first end of the blower unit, the at least one guide having a cross-sectional shape portion selected from a group consisting of T-shaped, circular shaped, diamond-shaped, arrow-shaped, S-shaped, E-shaped, triangular -shaped, K-shaped, star-shaped, and C-shaped, wherein the blower unit engagement feature comprises at least one groove formed on a first end of the filter wherein the at least one groove slidably engages the at least one guide.

42. The filter and blower unit of claim 39, wherein at least one of the filter engagement feature or blower unit engagement feature includes a flexible seal material.

43. The filter and blower unit of claim 39, wherein the blower unit further comprises:

a blower unit air outlet having an axis and extends from a first edge of the blower unit, the axis of the bower unit air outlet being at an oblique angle relative to the first edge of the blower unit; and a blower unit air inlet, wherein the blower unit air inlet and a replaceable thin profile filter air outlet included on the replaceable thin profile filter align to form an air conduit to the blower unit air outlet.

44. The filter and blower unit of claim 39, wherein the blower unit further comprises an external control connector.

45. The filter and blower unit of claim 39, further comprising at least one of:

a. the blower unit further comprises a safety lock receiving feature for engagement with a safety lock engaging feature of the filter; or b. the filter further comprises a safety lock receiving feature for engagement with a safety lock engaging feature of the blower unit.

46. The filter and blower unit of claim 39, wherein the filter and blower unit comprise a bulletproof material.

47. The filter and blower unit of claim 39, wherein the blower unit further comprises:

a blower connected to a control switch for controlling the operation of the blower;

a self-contained power source including at least one battery operationally connected to the blower;

blower unit operation indicator connected to the blower; and a blower unit attachment feature for attaching the blower unit to a wearer.

* * * * *